US008491182B2

(12) United States Patent
Berger et al.

(10) Patent No.: US 8,491,182 B2
(45) Date of Patent: Jul. 23, 2013

(54) SPRUNG BALANCE RESONATOR FOR A TIMEPIECE

(75) Inventors: Philomène Berger, Provence (CH); Emmanuel Graf, Le Locle (CH); Daniel Mallet, Le Luhier (FR); Frédéric Vaucher, La Chaux-de-Fonds (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 324 days.

(21) Appl. No.: 12/946,042

(22) Filed: Nov. 15, 2010

(65) Prior Publication Data

US 2011/0116347 A1 May 19, 2011

(30) Foreign Application Priority Data

Nov. 13, 2009 (CH) ..... 1762/09

(51) Int. Cl.
*G04B 15/00* (2006.01)
*G04B 17/04* (2006.01)

(52) U.S. Cl.
USPC ..... 368/127; 368/175; 368/177

(58) Field of Classification Search
USPC ..... 368/127, 168, 169, 175–177
See application file for complete search history.

(56) References Cited

U.S. PATENT DOCUMENTS

| | | | | |
|---|---|---|---|---|
| 3,673,376 | A * | 6/1972 | Kullmann | 219/121.64 |
| 2009/0135679 | A1 * | 5/2009 | Musy et al. | 368/177 |
| 2009/0168611 | A1 | 7/2009 | Gigandet et al. | |
| 2009/0245030 | A1 * | 10/2009 | Buhler et al. | 368/177 |

FOREIGN PATENT DOCUMENTS

| | | | |
|---|---|---|---|
| DE | 295 02 289 | U1 | 3/1995 |
| EP | 1 655 642 | A2 | 5/2006 |
| EP | 1 857 891 | A1 | 11/2007 |
| FR | 2 472 218 | A1 | 6/1981 |

OTHER PUBLICATIONS

Search Report issued in the corresponding European application 10 15 5184, completed Aug. 27, 2010.

* cited by examiner

*Primary Examiner* — Vit W Miska
(74) *Attorney, Agent, or Firm* — Griffin & Szipl, P.C.

(57) ABSTRACT

The invention relates to a resonator (11) with a balance (13) and balance spring (15) including a balance (13) mounted on a staff (17), a balance spring (15) integral with a collet (14) and mounted on said staff. According to the invention, the collet (14) includes an integral protruding portion or bump (16) forming a pin arranged for cooperating with an escape system.
The invention concerns the field of timepiece movements.

8 Claims, 1 Drawing Sheet

SPRUNG BALANCE RESONATOR FOR A TIMEPIECE

This application claims priority from Swiss Patent Application No. 01762/09 filed Nov. 13, 2009, the entire disclosure of which is incorporated herein by reference.

FIELD OF THE INVENTION

The invention relates to a sprung balance resonator for a timepiece and, more specifically, a resonator of this type that includes fewer parts.

BACKGROUND OF THE INVENTION

A sprung balance resonator generally has a configuration like that shown in FIG. 2. Thus, the resonator 1 includes a balance 3 driven onto a staff 7 so that it is rotatably mounted between a bridge and the bottom plate of a timepiece movement.

As shown in FIG. 2, in order to transmit its oscillation frequency to the escape system, balance 3 includes a pin 6 fitted in a recess of said balance. The balance spring 5 is fitted on the other side of the shoulder 8 of staff 7. The balance spring 5 includes a hairspring 2 formed in single piece with a collet 4, which is fitted onto staff 7.

SUMMARY OF THE INVENTION

It is an object of the present invention to simplify the fabrication of said sprung balance resonator by decreasing the number of parts and, incidentally, improving the quality of fabrication.

The invention therefore concerns a sprung balance resonator including a balance mounted on a staff, and a balance spring integral with a collet and mounted on said staff, characterized in that the collet includes an integral protruding portion or bump forming a pin, arranged to cooperate with an escape system.

It is thus clear that a balance spring-pin assembly is formed in a single piece, which allows perfect positioning between the pin, the collet and the balance spring, while decreasing the number of parts, i.e. simplifying the fabrication of the resonator. According to other advantageous features of the invention:

the protruding portion or bump forming a pin is mounted approximately parallel to said staff;

the protruding portion or bump is mounted through a recess of the balance;

the balance spring-pin assembly is formed from a silicon base.

The invention also relates to a timepiece characterized in that it includes a resonator according to any of the preceding variants.

Finally, the invention relates to a method of fabricating at least one balance spring, characterized in that it includes the following steps:

a) taking a substrate including a top layer and a bottom layer connected to each other via an intermediate layer;

b) etching at least one balance spring with an integral collet in the top layer;

c) etching at least one pin in the bottom layer connecting said collet so as to form a single piece balance spring-collet assembly; and d) releasing said balance spring-pin assembly from the substrate.

BRIEF DESCRIPTION OF THE DRAWINGS

Other peculiarities and advantages will appear clearly from the following description, given by way of non-limiting illustration, with reference to the annexed drawings, in which.

DETAILED DESCRIPTION OF PREFERRED EMBODIMENTS

Figure 1:
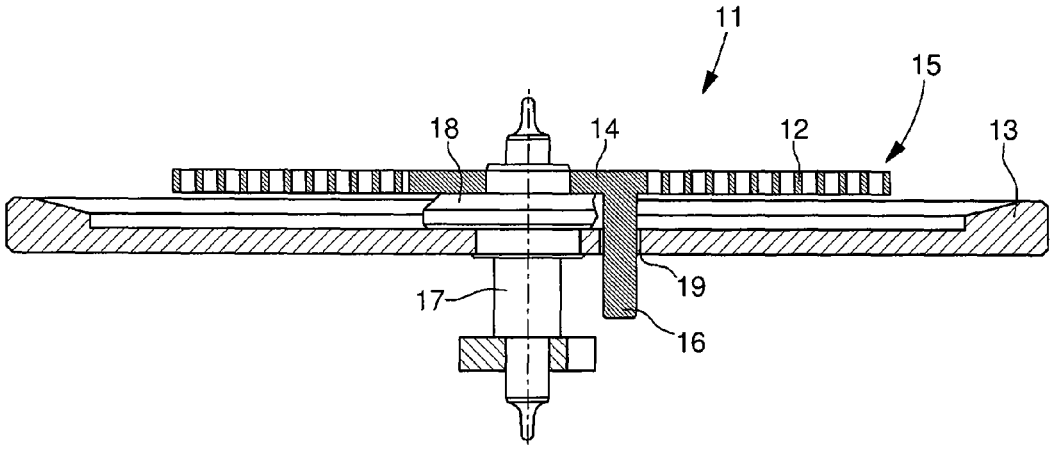
FIG. 1 is a cross-sectional diagram of a resonator according to the invention.

According to the invention, the resonator 11 includes a balance 13, driven onto a staff 17, such that it is rotatably mounted between a bridge and the bottom plate of a timepiece movement. Balance spring 15 is fitted on the other side of the shoulder 18 of staff 17. Balance spring 15 includes a hairspring 12, formed in a single piece with the collet 14, which is fitted onto staff 17. Advantageously, according to the invention, balance spring 15 also includes a pin 16, integral with balancespring 15 and connected to collet 14. Thus, balance spring 15 includes, integrally, not simply hairspring 12 and collet 14, but also pin 16.

Figure 2:
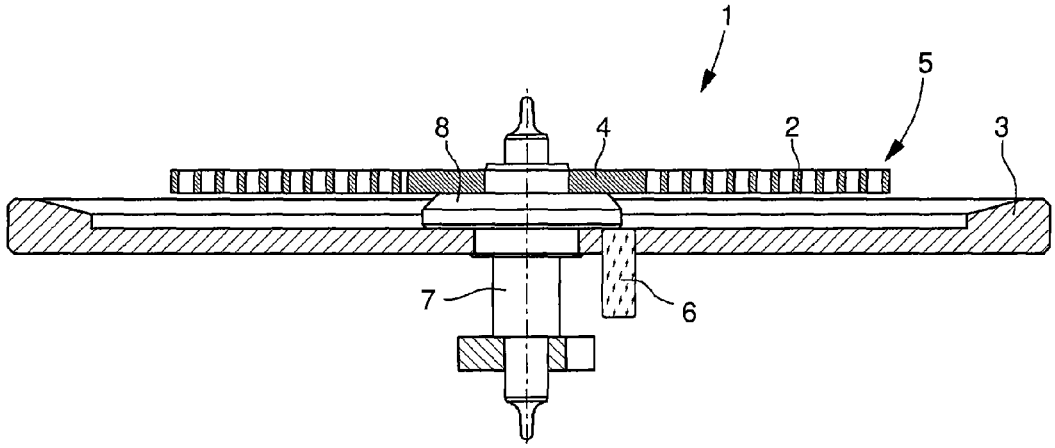
Fig. 2 Prior Art
FIG. 2 is a cross-sectional diagram of a resonator according to the prior art.

As can be seen in FIG. 2, balance 13 includes a recess 19 for receiving pin 16, so that said pin projects underneath balance 13. Thus, in the usual manner, pin 16 is for transmitting the oscillation frequency from resonator 11 to the escape system (not shown), i.e. for example, to the horns of a Swiss lever escapement. It is thus clear that fabrication of resonator 11 is simplified by comprising fewer parts and it also allows perfect positioning between pin 16, collet 14 and hairspring 12.

Preferably, according to the invention, the balance spring 15-pin 16 assembly is formed from a silicon base and, more specifically, from a monocrystalline silicon base. This is made possible by the use of an S.O.I. (Silicon On Insulator) type substrate. In fact, first of all, balance spring 15, i.e. hairspring 12 and collet 14, is etched in the top layer also called a "device". While, secondly, pin 16 is etched in the bottom layer, also called the "handle". The balance spring 15-pin 16 assembly then only needs, thirdly, to be released from the substrate. It is clear that series production is possible by etching several balance springs 15 on the same S.O.I substrate.

Of course, the present invention is not limited to the illustrated example, but is capable of various variants and alterations, which will be apparent to those skilled in the art. In particular, a final oxidation can be performed, in order to improve the strength of the hairspring 12-collet 14-pin 16 assembly.

What is claimed is:

1. A sprung balance resonator comprising:

(a) a balance mounted on a staff;

(b) a hairspring that has a collet, wherein the hairspring is integral with the collet, wherein the hairspring is mounted on the staff, wherein the collet includes an integral protruding portion or bump that protrudes from a plane of the hairspring and forms a pin arranged for cooperating with an escape system.

2. The resonator, according to claim 1, wherein the protruding portion or bump from the hairspring plane forming a pin, is mounted approximately parallel to said staff.

3. The resonator according to claim 1, wherein the protruding portion or bump is mounted through a recess in the balance.

4. The resonator according to claim 1, wherein an assembly of the hairspring and pin is formed from a silicon base.

5. A timepiece wherein it includes a resonator according to claim 1.

6. A method of fabricating a balance spring, the method comprising the steps:

a) providing a substrate including a top layer and a bottom layer connected to each other by an intermediate layer;

b) etching at least one hairspring with an integral collet in the top layer;

c) etching at least one pin in the bottom layer connecting said collet so as to form a single piece balance spring-pin assembly; and d) releasing said balance spring-pin assembly from the substrate.

7. The method according to claim 6, wherein several balance springs are fabricated from the same substrate.

8. A timepiece comprising a sprung balance resonator that includes a balance mounted on a staff and a hairspring that has a collet, wherein the hairspring is integral with the collet, wherein the hairspring is mounted on the staff, wherein the collet includes an integral protruding portion or bump that protrudes from a plane of the hairspring and forms a pin arranged for cooperating with an escape system.

* * * * *